US005800067A

United States Patent [19]

Easter

[11] Patent Number: 5,800,067

[45] Date of Patent: Sep. 1, 1998

[54] POP-UP COLLAPSIBLE PROTECTIVE DEVICE

[76] Inventor: Scott D. Easter, 322 Southburn Dr., Hendersonville, Tenn. 37075

[21] Appl. No.: 611,811

[22] Filed: Mar. 1, 1996

Related U.S. Application Data

[63] Continuation of Ser. No. 202,212, Feb. 25, 1994, abandoned.

[51] Int. Cl.[6] ..... B65D 33/02

[52] U.S. Cl. ..... 383/104; 383/127; 220/92; 135/126

[58] Field of Search ..... 383/33, 34, 104, 383/119, 127; 220/9.1, 9.2, 9.3; 135/126, 128

[56] References Cited

U.S. PATENT DOCUMENTS

| | | | |
|---|---|---|---|
| 1,139,281 | 5/1915 | Hazelton | 383/119 |
| 1,647,679 | 11/1927 | Williams | 220/9.2 |
| 2,042,977 | 6/1936 | Ahlmark et al. | 220/9.3 |
| 2,115,308 | 4/1938 | Koch | 220/9.2 X |
| 2,228,248 | 1/1941 | Ahlmark | 220/9.3 |
| 2,958,357 | 11/1960 | Vorgan | 220/9.3 X |
| 3,746,151 | 7/1973 | Brophy et al. . | |
| 4,059,464 | 11/1977 | Geller et al. . | |
| 4,099,656 | 7/1978 | Neumann et al. . | |
| 4,180,112 | 12/1979 | Bovet . | |
| 4,561,480 | 12/1985 | Underwood et al. | 383/34 |
| 4,815,784 | 3/1989 | Zheng . | |
| 4,938,243 | 7/1990 | Foster | 135/128 X |
| 4,950,087 | 8/1990 | Carey . | |
| 4,985,721 | 1/1991 | Moon | 383/119 X |
| 5,038,812 | 8/1991 | Norman | 135/126 |
| 5,117,952 | 6/1992 | Suh . | |
| 5,213,147 | 5/1993 | Zheng | 383/72 X |
| 5,249,592 | 10/1993 | Springer et al. | 135/126 |
| 5,301,705 | 4/1994 | Zheng . | |
| 5,396,917 | 3/1995 | Hazinski et al. . | |
| 5,411,046 | 5/1995 | Wan | 135/126 |

FOREIGN PATENT DOCUMENTS

| | | | |
|---|---|---|---|
| 2453085 | 5/1976 | Germany | 135/126 |

*Primary Examiner*—Jes F. Pascua
*Attorney, Agent, or Firm*—Chester T. Barry

[57] ABSTRACT

The present invention is directed to a protective device for articles such as portable stereos, radios, cassette and CD players, and other articles easily misplaced or lost. The invention comprises a flexible fabric body structure and an internal, preferably metallic, skeletal structure. The invention has pop-up and collapsible capability, and is configured with an easy access entryway for the introduction and storage of articles.

15 Claims, 2 Drawing Sheets

POP-UP COLLAPSIBLE PROTECTIVE DEVICE

This is a continuation of application Ser. No. 08/202,212 filed on Feb. 25, 1994 now abandoned.

BACKGROUND OF THE INVENTION

1. Field of the Invention

The present invention relates generally to collapsible, pop-up type devices, such as pop-up tents, auto shades, and golf practice devices, to name a few. The present invention also relates to collapsible protective bags, canopies, or other containers and covers for protecting articles from, for example, environmental conditions.

2. Description of the Related Art

A common problem associated with outdoor activities such as a day at the lake or beach, or in the forest, is the inability to protect and shield a persons possessions from the potentially damaging effects of the outdoor elements. The person's possessions may include devices or other articles whose loss would be disturbing to the individual owner (e.g., car keys, wallets, cellular telephones, etc.). For example, devices such as stereos, radios, CD players and the like, hereinafter collectively referred to as "musical devices" often require protection from the elements when used outdoors.

As an example and not by way of limitation, musical devices, car keys, and wallets are particularly cumbersome when spending the day at the beach. The musical devices should be protected from sand, water, solar rays, and other substances such as suntan oils to prevent damage to the device. Articles such as keys and wallets, which may easily become lost in the sand, need to be secured in a place enabling easy retrieval of those articles. A beverage cooler is often a common place to stow keys and other valuables, but certainly not particularly well suited for stowing musical devices.

One way to protect musical devices is to place the device beneath a canopy. A beach umbrella is one common example of a suitable canopy under which the musical device can be stowed in order to shield it from harmful and damaging effects of the sun. With this arrangement, however, the musical device is not protected from water, sand or other substances such as suntan oil or lotion, beverages and the like.

Another means of protection is to place the musical device inside a bag, or some other bag-like article, which is usually made of plastic. In this fashion the device will be protected from impinging sand, and potentially capable of repelling water and other substances, but the quality and quantity of the sound transmission from the device is usually severely diminished. Accordingly, bags, plastic wraps and the like are believed not to be particularly well-suited for stowing and protecting musical devices. In addition, such bags and wraps are cumbersome when the user wishes to operate the device such as when changing a tape or CD to be played.

A common concern associated with using a device such as a radio at the beach, lake or other recreation area, is the inability to protect the radio from the elements while leaving the antenna free for reception of the FM or AM radio signals. If one were to wrap the radio in a plastic or fabric bag, it becomes difficult, in the manner mentioned above, to operate the various controls of the radio including orienting the antenna to maximize signal reception.

Accordingly, it is desirable to provide a device capable of shielding or protecting valuable articles while allowing the user easy access to those articles. In addition, it would be advantageous to provide a device configured to enable musical devices such as radios, cassette and CD players, and the like to emit their sound waves with minor interruption or impedance. It is also desirable to configure such a device to have the capability of being collapsible and stowable in a relatively small space.

Until now, a collapsible, flexible, pop-up type device configured to provide protection of a musical device or other articles while allowing easy access to the device or article with minimal interruption in the sound quality produced in the case of a musical device, has not been invented.

SUMMARY OF THE INVENTION

The present invention is directed to a pop-up container device for protecting articles stowed therein. The device may also be referred to by any number of names including a flexible pop-up type protective bag or a pop-up type collapsible protective bag, which are operable between a collapsed position and a supported position, and have an interior capable of receiving a musical device.

The invention includes a collapsible body having an opening and an internal cavity or article receiving interior. The body is preferably constructed of a collapsible fabric made of an air and sound wave pervious material such as spandex. The collapsible fabric body can also be said to include an opening, a top defining a first area and a bottom defining a second area, and a central body portion disposed therebetween. The central body portion, and top are particularly useful for displaying artwork including advertising messages, logos, symbols, words or graffiti. The body may also include pockets to provide the user with additional storage compartments, and a sun reflecting top panel.

The invention also includes a skeletal support means for supporting the collapsible body. The skeletal support structure preferably occupies the interior of the device and is configured to be collapsible without the need for removing it from the interior. The skeletal support structure preferably includes a plurality of flexible metal stays, wherein a pair of stays provides vertical support for the body. The plurality of stays are preferably constructed of flexible strips of metal capable of being coiled. When coiled, the plurality of stays reduce the invention in size to preferably define an area smaller than the area of the top or bottom.

The plurality of stays may also include a pair of spaced apart top and bottom stays and a sleeve means for holding the stays in proper operative alignment. When the preferred embodiment of the invention is in the operable position, the vertical stays are positioned adjacent to and outside of the top stay enabling the top stay to hold or lock the vertical stays in the operable position to prevent collapse.

The body may also include means for closing the opening or cavity. The means may be in the form of a zipper, VELCRO closures, snaps or any fastener suitable to close an opening in fabric.

It is an object of the present invention to provide a pop-up collapsible protective device for stowing articles such as musical devices.

It is an object of the present invention to provide a pop-up protective device for shielding musical devices from the elements.

It is an object of the present invention to provide a collapsible or pop-up protective device which occupies a smaller planar area when fully collapsed than when not fully collapsed.

It is an object of the present invention to provide a lightweight protective device for stowing articles, wherein the device has a collapsible pop-up skeletal structure.

It is an object of the present invention to provide a metallic skeletal structure useful as a component of a pop-up protective device.

It is an object of the present invention to provide a pop-up or collapsible protective device for musical devices, wherein the protective device is configured to allow for the transmission of sound waves but enable the musical device to be fully or substantially enclosed within the protective device.

It is an object of the present invention to provide a pop-up protective device with a fabric body, wherein the fabric is pervious to air and sound waves but substantially impervious to particulate matter such as sand, dirt, and the like.

It is an object of the present invention to provide a pop-up protective device having a closure mechanism for closing off the interior of the device when articles are stowed therein.

The stated objects and advantages are exemplary and are not intended to limit the scope of the present invention. These and other objects will become apparent after consideration of the attached description and claims. All such additional objects, advantages and features of the present invention are deemed to be within the scope of the present invention.

DETAILED DESCRIPTION OF THE PREFERRED EMBODIMENTS

Figure 1:
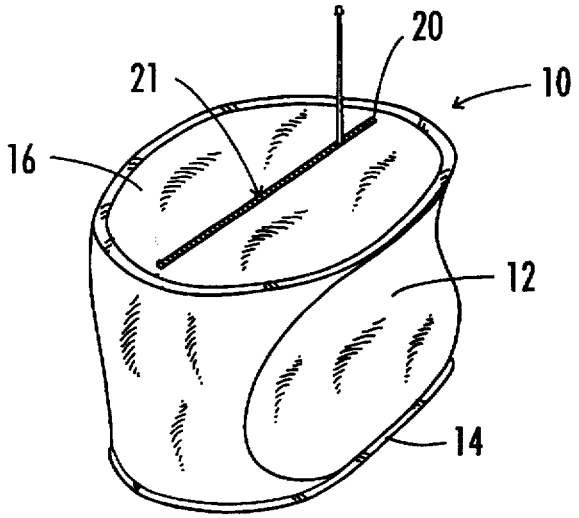
FIG. 1 is a prospective view of an embodiment of the present invention shown in its operable position.
Figure 2:
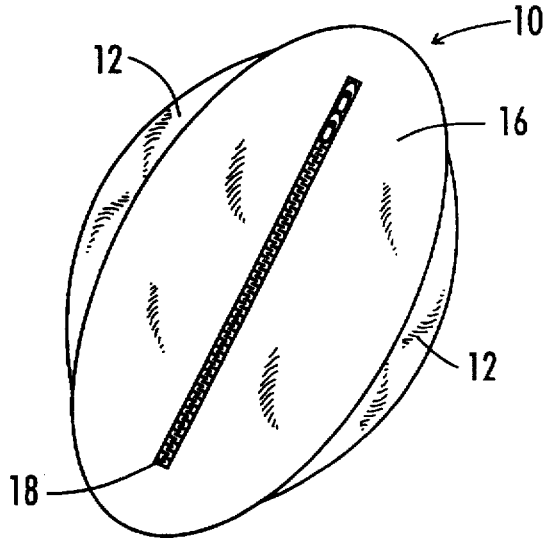
FIG. 2 is a prospective view of the invention shown in FIG. 1 in a collapsed position.

An preferred embodiment of the present invention is shown in FIGS. 1 and 2 and designated generally by the reference numeral 10. Embodiment 10 incorporates a central body portion 12 having a spaced apart bottom panel 14 and top panel 16 attached thereto. Bottom panel 14 defines a first planar area, and a top panel 16 defines a second planar area. In the preferred embodiment of the invention, the central body portion 12 is a means for displaying artwork. Also with respect to the preferred embodiment, top panel 16 is formed of a sun reflective material and has an opening 18, and the opening incorporates a zipper 20 enabling the slit to be opened or closed at the user's discretion. In addition, in alternate embodiments of the present invention, the slit may be overlapping flaps of material which form the top panel 16. Optional storage pockets 21 may be positioned on the exterior or interior (not shown) of the central body portion to provide the user with additional storage compartments.

Ideally, the bottom portion does not have an opening but in alternate embodiments of the present invention, it may have a supplemental opening such that an electrical cord can be passed therethrough and thus communicate the interior 21 with the outside environment.

In the preferred embodiment of the invention, an inner skeletal support structure, designated generally by the reference numeral 22, is provided as the means of support to hold the collapsible body in an upright position and maintain the top and bottom portions 14 and 16 respectively in spaced apart relationship. The support structure is shown in FIG. 3 and generally comprised of a plurality of metallic stays which are preferably looped to form ovals or ellipses.

Bottom stay 24 is associated with the bottom panel 14, top stay 26 is associated with the top panel 16, and vertical support stays 28 and 30 provide the upward vertical support of the top portion 16. Arrows 32 and 34 indicate the preferred direction in which the vertical support stays 28 and 30, respectively, are folded to enable the device to be completely collapsible and take on the position as shown in FIG. 2.

In this fashion it is important to point out that the preferred embodiment also includes a sleeve segment 36 and 38. Sleeve segment 38 enables the vertical stay 28 to pivot in the direction of the arrow 32. Of course, if the embodiment of the invention is in the collapsed position as shown in FIG. 2, the direction of the arrow 32 would be reversed in order to prop up the top portion 16 as shown in FIG. 1.

Figure 3:
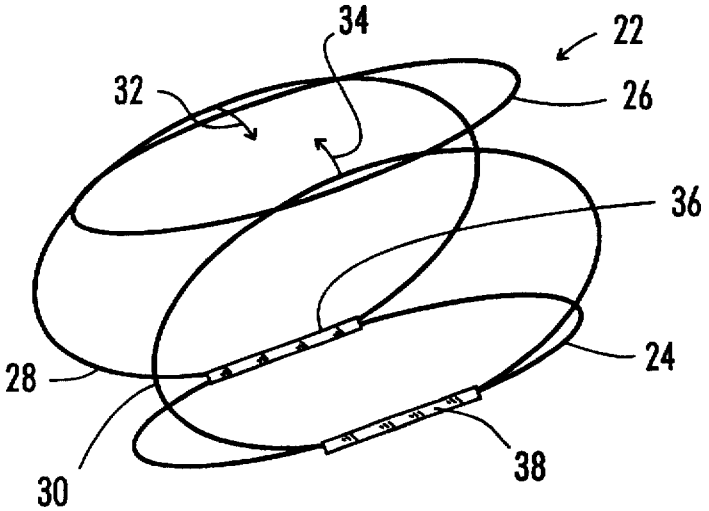
FIG. 3 is a prospective view of the skeletal support structure of the invention shown in FIG. 1.
Figure 4:
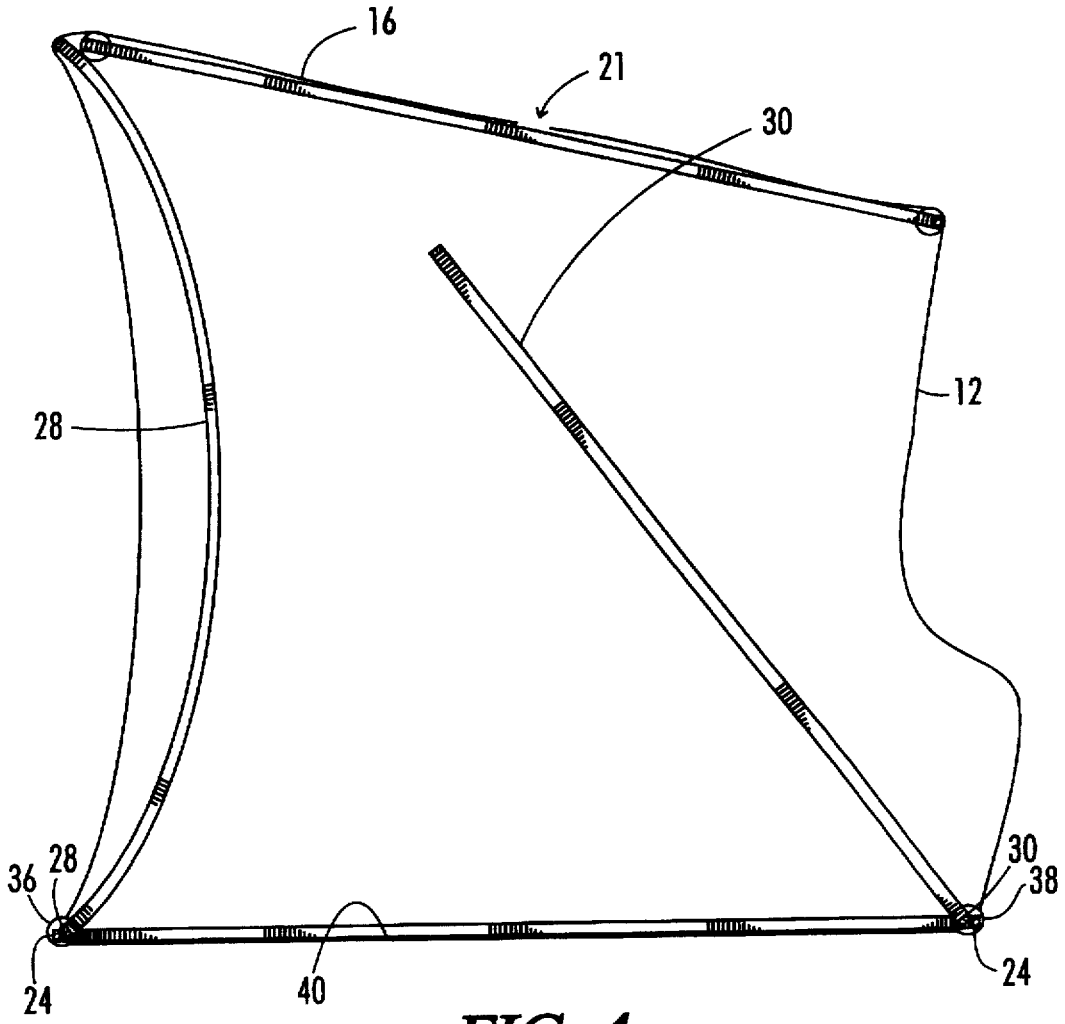
FIG. 4 is a cross-sectional view taken along plane F4—F4 of FIG. 1.

Similarly, sleeve segment 38 is provided to hold vertical stay 30 in alignment with bottom stay 24 and enable stay 30 to pivot in the direction of arrow 34 (FIG. 3). With reference to FIG. 4, the cross-section illustrates the relative alignment of vertical stays 28 and 30 with respect to the collapsible body 12. Sleeve segments 36 and 38 are shown having stay components 28 and 24, and 30 and 24, respectively, held therein. In use, vertical stays 28 and 30 are positioned adjacent to but outside of the top stay 26 to hold the invention in an operable position and to prevent inadvertent collapse.

Figure 5:
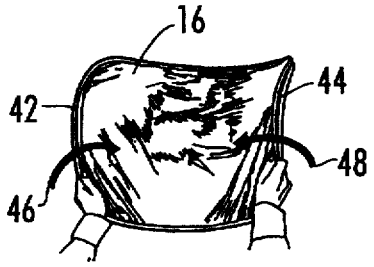
FIGS. 5 through 7 illustrate the foldability and stowability of the fully collapsed device shown in FIG. 2.
Figure 6:
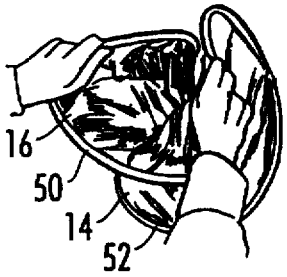
Figure 7:
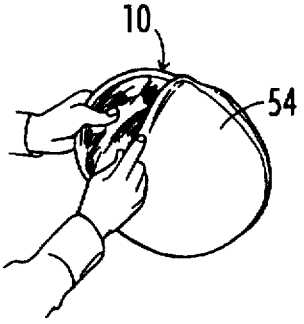

With reference to FIGS. 5 through 7, the device may be fully collapsed by the user by folding the vertical stays 28 and 30 in the direction of the arrows (FIG. 3) such that they rest on the interior surface 40 of the bottom portion 14, enabling the invention to assume the position shown in FIG. 2. The user then grasps ends 42 and 44 and bends sides 42 and 44 in the direction of the arrows 46 and 48, as shown in FIGS. 5 and 6. The stays then coil causing the device to occupy a smaller planar area than the planar area defined by the top or the bottom when the device is uncoiled.

Opposite ends 50 and 52 then, by the nature of the stays, are caused to join one another in a collapsible fashion as shown in FIG. 6. After the invention is fully collapsed, it can be inserted into optional carry-bag 54, as shown in FIG. 7.

These and other embodiments of the present invention will become apparent after consideration of the attached drawing. All such alternate embodiments and additional features are believed to be contemplated or included within the scope of the present invention.

What is claimed is:

1. A pop up container device for protecting articles stowed therein, comprising:

a collapsible body having a sidewall, a bottom, a top forming an opening and an internal cavity;

skeletal support means for supporting the collapsible body;

the skeletal support means includes a plurality of stays including a pair of spaced apart support stays, and sleeve means for pivotally constraining only a portion of each of the pair of spaced apart support stays within the collapsible body and enabling each of the spaced apart support stays to pivot freely within the internal cavity of the collapsible body between a collapsed position and a substantially upright position to prop up the top of the collapsible body and hold it in an elevated relation to the bottom in order to prevent inadvertent collapse of the collapsible body.

2. The device of claim 1, wherein:

the collapsible body is a flexible bag.

3. The device of claim 2, wherein:

the flexible bag is made of an air pervious material.

4. The device of claim 3, wherein:

the air pervious material is spandex.

5. The device of claim 1 wherein:

the plurality of stays are flexible strips of metal.

6. The device of claim 1, further including:

a pair of spaced apart top and bottom stays.

7. The device of claim 1, further including:

means for closing the opening.

8. A flexible pop-up protective bag, comprising:

a collapsible fabric body having an article receiving interior, a bottom, and a top with an opening leading into the article receiving interior;

a skeletal support structure for supporting the body in an operable position from the interior thereof;

the skeletal support structure includes a pair of spaced apart support stays, and sleeve means for pivotally securing only a portion of each of the pair of spaced apart support stays and enabling each of the spaced apart support stays to pivot freely within the article receiving interior between a collapsed position parallel to the bottom and a substantially upright position to prop up the top of the collapsible fabric body and hold it in an elevated relation to the bottom in order to prevent inadvertent collapse of the collapsible body.

9. The bag of claim 8, wherein:

the skeletal support structure is partially comprised of a plurality of metallic stays.

10. The bag of claim 8, wherein the skeletal support structure further includes:

a pair of top and bottom spaced apart stays.

11. The bag of claim 8, wherein:

the fabric is pervious to air permitting sound and air transmission therethrough.

12. The bag of claim 11, further including:

means for operably closing the opening.

13. A pop-up type collapsible bag, operable between a collapsed position and a supported position, and having an interior capable of receiving a musical device, comprising:

a collapsible fabric body having an opening, a bottom defining a first planar area and a top defining a second planar area, and a central body portion disposed therebetween;

a flexible skeletal support structure including a plurality of bendable stays enabling the body to be supported in an operable position, and the flexible skeletal support structure includes a pair of spaced apart support stays, and sleeve means for pivotally holding only a portion of each of the pair of spaced apart support stays within the interior and enabling each of the spaced apart support stays to pivot freely within the interior between a collapsed position and a supporting position to prop up the second planar area and hold it in a spaced elevated relationship to the first planar area in order to prevent inadvertent collapse of the collapsible body.

14. The bag of claim 13, wherein:

the stays are capable of being coiled enabling the bag to be reduced in size to define a third area smaller than the first and second areas.

15. The bag of claim 13, further including:

means for closing the opening.

* * * * *

UNITED STATES PATENT AND TRADEMARK OFFICE

CERTIFICATE OF CORRECTION

PATENT NO. : 5,800,067

DATED : September 1, 1998

INVENTOR(S) : Easter

It is certified that error appears in the above-identified patent and that said Letters Patent is hereby corrected as shown below:

In claim 12, at column 6, line 7, the claim reference numeral "11" should read--8--.

Signed and Sealed this

Fifteenth Day of December, 1998

*Attest:*

*Attesting Officer*

BRUCE LEHMAN

*Commissioner of Patents and Trademarks*